US005231910A

United States Patent [19]

Harsch et al.

[11] Patent Number: 5,231,910

[45] Date of Patent: Aug. 3, 1993

[54] DEVICE FOR PRODUCING U-SHAPED SURFACE CHANNELS IN SHEETING

[75] Inventors: Georg Harsch, Tamm; Joachim Müller, Weil der Stadt, both of Fed. Rep. of Germany

[73] Assignee: C. & E. Fein GmbH & Co., Stuttgart, Fed. Rep. of Germany

[21] Appl. No.: 796,573

[22] Filed: Nov. 22, 1991

[30] Foreign Application Priority Data

Nov. 28, 1990 [DE] Fed. Rep. of Germany ..... 4037790
Mar. 13, 1991 [DE] Fed. Rep. of Germany ..... 4107989

[51] Int. Cl.[5] ..... B26B 9/02; B26D 3/06

[52] U.S. Cl. ..... 83/875; 30/272.1; 30/277.4; 30/294

[58] Field of Search ..... 83/875; 30/272.1, 277.4, 30/294, 314, 317, 287; 29/239, 270

[56] References Cited

U.S. PATENT DOCUMENTS 3,740,847 6/1973 Kliever et al. ..... 30/277.4
4,485,715 12/1984 Hytti ..... 83/875
4,543,720 10/1985 Grunikiewicz et al. ..... 30/277.4
4,656,910 4/1987 Peterson ..... 83/875
4,700,478 10/1987 Mezger et al. ..... 30/294
4,989,320 2/1991 Borkott et al. ..... 30/272.1
5,038,478 8/1991 Mezger et al. ..... 30/272.1
5,065,804 11/1991 Kinuhata et al. ..... 83/875

FOREIGN PATENT DOCUMENTS 8702754 5/1987 Fed. Rep. of Germany .
3839029 5/1990 Fed. Rep. of Germany .

*Primary Examiner*—Scott Smith
*Attorney, Agent, or Firm*—Barry R. Lipsitz

[57] ABSTRACT

A device is disclosed for producing surface channels of at least approximately rectangular cross-section in sheeting consisting of a soft material, in particular mineral-fiber insulating mats or sheeting consisting of a styrene polymer. The device makes use of a motor-operated cutting tool with an oscillating cutter. The cutter comprises sections which are bent off relative to each other and which are provided with a cutting edge, at least in part. The cutting edge extends over at least three of two sections which form together a U or L, respectively. The cutter is passed through the sheeting approximately along a straight line.

5 Claims, 6 Drawing Sheets

FIG. 8
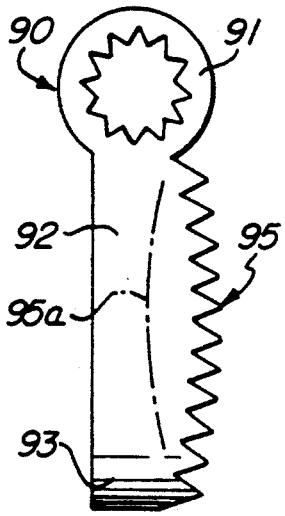
FIG. 9
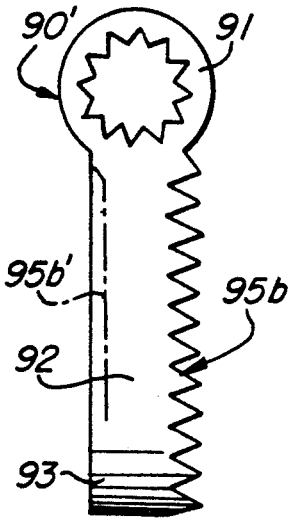
FIG. 10
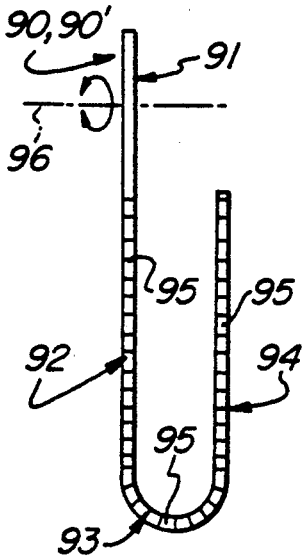
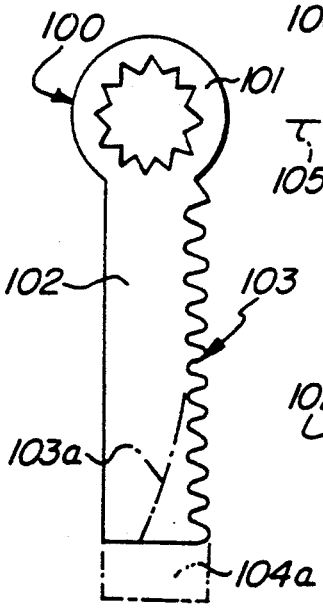
FIG. 11
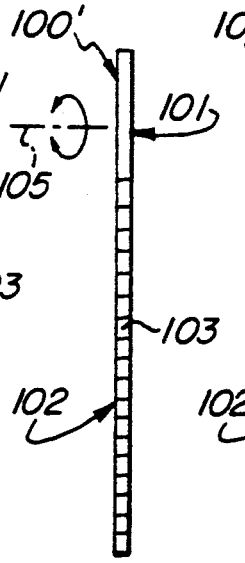
FIG. 12
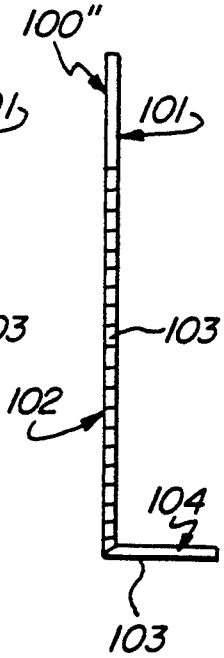
FIG. 13
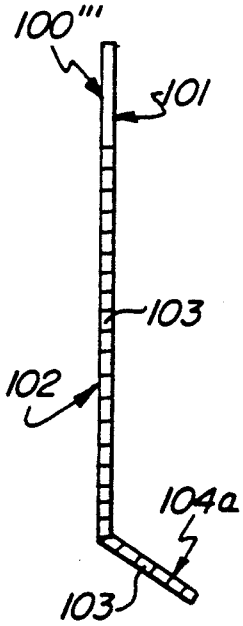
FIG. 14

DEVICE FOR PRODUCING U-SHAPED SURFACE CHANNELS IN SHEETING

The present invention relates to a method for producing surface channels of at least approximately rectangular cross-section in sheeting consisting of a soft material, in particular mineral-fiber insulating mats or sheeting consisting of a styrene polymer, using a motor-operated cutting tool with an oscillating cutter.

The present invention further relates to a device for producing surface channels of at least approximately rectangular cross-section in a sheeting consisting of a soft material, in particular mineral-fiber insulating mats or a sheeting consisting of a styrene polymer, using a motor-operated cutting tool, where a cutter is moved to oscillate about an axis at an angular amplitude in the range of about 0.5° to 7° and a frequency in the range of about 10,000 to 25,000 $min^{-1}$ and where the cutter comprises sections which extend at an angle relative to each other and which are provided with a cutting edge at least in part.

Finally, the present invention relates to an application of the before-mentioned device.

According to a prior art method for cutting up joints in building structures, which are filled with a soft material, a cutting tool is used where the cutter oscillates about an angle of 2° at a frequency of about 20,000 $min^{-1}$. The cutter used for this purpose has a rectangular or triangular blade, tapering in forward direction, viewed from the top.

In practice, such electric joint cutters sometimes have been employed also to cut surface channels into sheeting consisting of a soft material, in particular into aluminium-lined glass-fiber insulating mats. Such surface channels are applied in such mats in order to provide room for conduits, for example water or gas pipes, or electric lines.

It has been known in this connection to apply two parallel cuts in the surface of the sheeting, using the before-described electric joint cutter, and to remove thereafter the material left between the two parallel cuts, for example by means of a usual pocket knife or a screwdriver.

However, this known manner of proceeding is very time-consuming, requiring a total of three operations, namely two cutting operations and the process of removing the material, which latter is particularly time-consuming because the material to be removed still has to be separated from the surrounding material at the bottom—i.e. the bottom of the channel to be formed—where the material has not been cut off before. It is further obvious that such a manual operation must of course be extremely imprecise because it is hardly possible, in particular under the rough conditions of a site, to make two exactly parallel cuts of exactly the same depth, and to remove thereafter the material left between the two cuts down to an exactly constant, unchanging depth, using a screwdriver or some other relatively simple tool.

On the other hand, it is a fact that today conversion, extension and, in particular, modernization projects are being carried out to an ever increasing degree on existing buildings where glass-fiber insulating mats are extensively used for filling wooden structures, for insulating purposes, and the like. All these "small-scale" building works, connected with the modernization of buildings or with the creation of new residential space in lofts, basements or the like, give rise to the before-mentioned problem that surface channels have to be cut into glass-fiber insulating mats, and this to an ever increasing extent.

Another cutting tool of the before-mentioned kind, which likewise makes use of an oscillating cutter, has been known from DE-OS 37 19 073. In the case of this known cutting tool, the cutter comprises a blade which is bent off by 90° and whose two legs are each provided with a cutting edge.

This known cutter is intended to serve the sole purpose of cutting off elastic adhesive bands on vehicle windows. This special tool is neither intended nor suited for other applications. In particular, it is not suited for producing surface channels in sheeting consisting of a soft material because the outer leg of the blade extends in parallel to the lower surface of the electric tool and an acute angle is enclosed between the oscillating shaft and the cutting edges which makes it impossible to cut into the surface of a sheet material.

Now, it is the object of the present invention to improve a method and a device of the before-described type, and to specify an application which enables surface channels to be produced in sheeting consisting of a soft material in a time-saving, simple and reproducible manner.

The before-mentioned method achieves this object by the fact that a U-shaped cutter whose cutting edge extends over the sections forming the U, is passed through the sheeting along a straight line.

The before-mentioned method on the other hand achieves this object by the steps of passing initially an L-shaped cutter, whose cutting edge extends over the sections forming the L, through the sheeting substantially along a straight line, and passing thereafter a cutter having a straight section through the sheeting in parallel to the cutting line of the first cut in such a way that a continuous loose strip of the material can be removed from the sheeting.

In the last-mentioned case, the first and the second steps preferably are carried out several times in succession and in parallel for the purpose of producing wide surface channels.

According to the before-mentioned device, the invention achieves the underlying object on the one hand by the fact that the cutting edge extends over at least three sections forming together an U.

According to the before-mentioned device, the invention achieves the underlying object on the one hand by the fact that the cutting edge extends over at least two sections forming together an L.

Finally, the object underlying the invention is achieved by the application of a device of the before-mentioned kind for producing surface channels of at least approximately rectangular cross-section in a sheeting consisting of a soft material, in particular in mineral-fiber insulating mats.

This solves the object underlying the invention fully and perfectly.

The U-shaped cutter of the one embodiment of the invention, which comprises a total of at least three cutting edges, has the effect that a complete surface channel is cut out by a single cut extending from surface to surface and by a single operation.

It is ensured in this case that the cut-out channel has the same width and depth over its full length so that the desired channel can be cut out by a single operation, if a suitable cutter is selected, depending on the number and size of the lines to be installed. It is then only necessary to apply the tool and to guide it once along the desired course of the channel.

The L-shaped cutter of the other embodiment of the invention, with a total of two cutting edges, has the effect that in a first step two sides of the surface channel are cut out, while the third side is cut out subsequently, by a second operation.

This provides the advantageous possibility to produce surface channels of any desired width, by carrying out the two operations a desired number of times in parallel. The L-shaped cutter then cuts off a further strip of the material at the bottom, at the side of the channel already cut out, which additional strip is then cut off in the longitudinal direction by the next operation, whereafter it can be removed or will fall off.

In both cases, the cut-off piece of material only has to be taken off the cut-out channel, without the need to separate it from the remainder of the material, so that in practice no separate operation is required for this purpose since the cut-out material will come off the produced channel all by itself, or will fall off the working surface if the latter is inclined.

Compared with the method previously employed, this results in dramatical time-savings, on the one hand because only a single, instead of two, operation is required, but on the other hand also because the channel so produced will have a nominal dimension over its full length sufficient to accommodate safely all envisaged lines.

According to a preferred further improvement of the device according to the invention, at least one of the free ends of the sections forming the U is followed by another section which is bent off by approximately 90°.

If the bent-off section extends to the outside, i.e. away from the mounting end, then this feature provides the advantage that the additional section may be supported on the surface of the sheeting so as to prevent the cutter from sinking into the sheeting in an uncontrolled manner during cutting of the surface channel.

According to a particularly preferred embodiment of the invention, the bent-off section is provided at the outer free end of the section forming the U, extends toward the mounting end, and is supported by one of the sections on the mounting end. The additional support achieved in this manner for the outer part of the cutter leads to a considerable improvement of the mechanical stability of the cutter.

In addition, this arrangement eliminates a possible risk of breakage that may result from wear of the cutter in the area of the bent-off section.

The support may be implemented in a simple way by welding the bent-off section to one of the sections on the mounting end, for example by spot welding.

According to other preferred embodiments of the device according to the invention, the cutter is provided with a blade holder adapted to receive exchangeable blades.

This feature provides the advantage that surface channels of different widths, depths or other contours can be cut with the aid of one and the same blade holder, in close succession in time, with a minimum of re-fitting time being required.

In the case of this embodiment of the invention, it is particularly preferred if the blade has a U-shaped design and if its free ends can be fixed in slots provided in the blade holder.

It is then possible to provide the blade holder with a plurality of parallel slots for the production of channels of different widths and/or with locking means permitting the free ends to be fixed at different levels, for producing channels of different depths. This is possible in particular when the fixing means are designed as tongues which are provided in the slots and are adapted to engage matching slots provided in the free ends.

All these features provide the advantage that surface channels of different widths and/or depths can be cut with only a few manipulations. In the case of the last-mentioned embodiments, it is even possible to produce surface channels of different depths with one and the same blade.

In the case of those embodiments of the invention which make use of an L-shaped cutter, it is particularly preferred if a non-angular cutter can be mounted in the cutting tool, alternatively to the L-shaped cutter.

This feature provides the advantage that the material strips, after having been cut off on one side or on two sides, can be cut out at the third side by means of a straight, non-angular cutter.

According to certain embodiments of the invention, the cutting edges are toothed or undulated rather than plain.

This feature provides the advantage that the invention can be employed with particular advantage also in connection with soft materials having a relatively coarse structure. Typical examples of such materials are styrene polymers of the type commercially available, for example, under the registered trademark STYROPOR. If in the case of such materials cutters with a plain cutting edge are used, it may happen that the material beads composing the structure of the material get detached from the material without being cut through. This is connected with the disadvantage that an inaccurate cutting line is obtained, and in addition the surroundings in the area of the cut are soiled more than necessary. Now, it has been found that in such cases, and in particular when cutters with a plain cutting edge are already a little blunt, the use of toothed or undulated blades offers an effective remedy. Preferably, the spacing between the individual teeth or undulations is selected in this case to be greater than the diameter of the beads of the styrene polymer.

In the case of these embodiments of the invention using a toothed or undulated cutting edge it is particularly preferred if the cutter is provided with a plain cutting edge on its one side, in one cutting direction, and with a toothed or undulated cutting edge on its other side, in opposite cutting direction.

This feature provides the advantage that one and the same tool can be used for two different materials. If the tool with the cutter mounted therein is to be used in a fibrous material, it is only necessary to pass its plain cutting edge through the material in the one cutting direction, whereas if another, coarse material has to be cut, the toothed or undulated cutting edge is passed through the material in the opposite cutting direction. This is a particular advantage especially in connection with interior construction work when mineral-fiber mats on the one hand and styrene polymer sheeting on the other hand, both being employed for thermal insulation purposes, are worked in parallel or in immediate succession. It is then not necessary for the user to change the cutter; rather he can work both materials with the same tool, except that the cutter must be passed through the material in one direction for one material, and in the other direction for the other material.

According to certain other embodiments of the invention, the cutting edge has a curved shape, preferably a convex shape. This feature also provides the advantage that improved cutting results are obtained for numerous applications, whether plain, toothed or undulated cutting edges are provided along the curved shape.

Still other embodiments of the invention distinguish themselves by cutters where at least one of the sections provided with a cutting edge exhibits a tapering design.

This embodiment of the cutters, too, offers advantages as regards the cutting quality in numerous applications.

Finally, there are still other preferred embodiments of the invention where the axis extends at a right angle relative to a first section which is provided with the cutting edge and is located next to the mounting section of the cutter.

This conventional feature provides the advantage that the motor-operated cutting tool can be guided with its longitudinal axis extending perpendicularly to the material surface, which is of advantage under ergonomical aspects in numerous applications and ensures good access to the material.

Other advantages of the invention will appear from the specification and the attached drawing.

It is understood that the features that have been described before and will be explained hereafter may be used not only in the described combinations, but also in any other combination, or individually, without leaving the scope and intent of the present invention.

Certain embodiments of the invention will now be described in more detail with reference to the drawing in which:

FIG. 8 shows a side view, similar to FIGS. 3 and 5, of another embodiment of a cutter of the type that may be used according to the present invention;

FIG. 9 shows a variant of the embodiment illustrated in FIG. 8;

FIG. 10 shows a side view of the cutter represented in FIG. 8, but turned by 90°;

FIG. 11 is another representation, similar to FIGS. 8 and 9, of a cutter which may also be used according to the invention;

FIG. 12 shows a side view of the cutter illustrated in FIG. 11, but turned by 90°;

FIG. 13 shows a variant of the embodiment illustrated in FIG. 12;

FIG. 14 shows another variant of the embodiment illustrated in FIG. 12;

Figure 1:
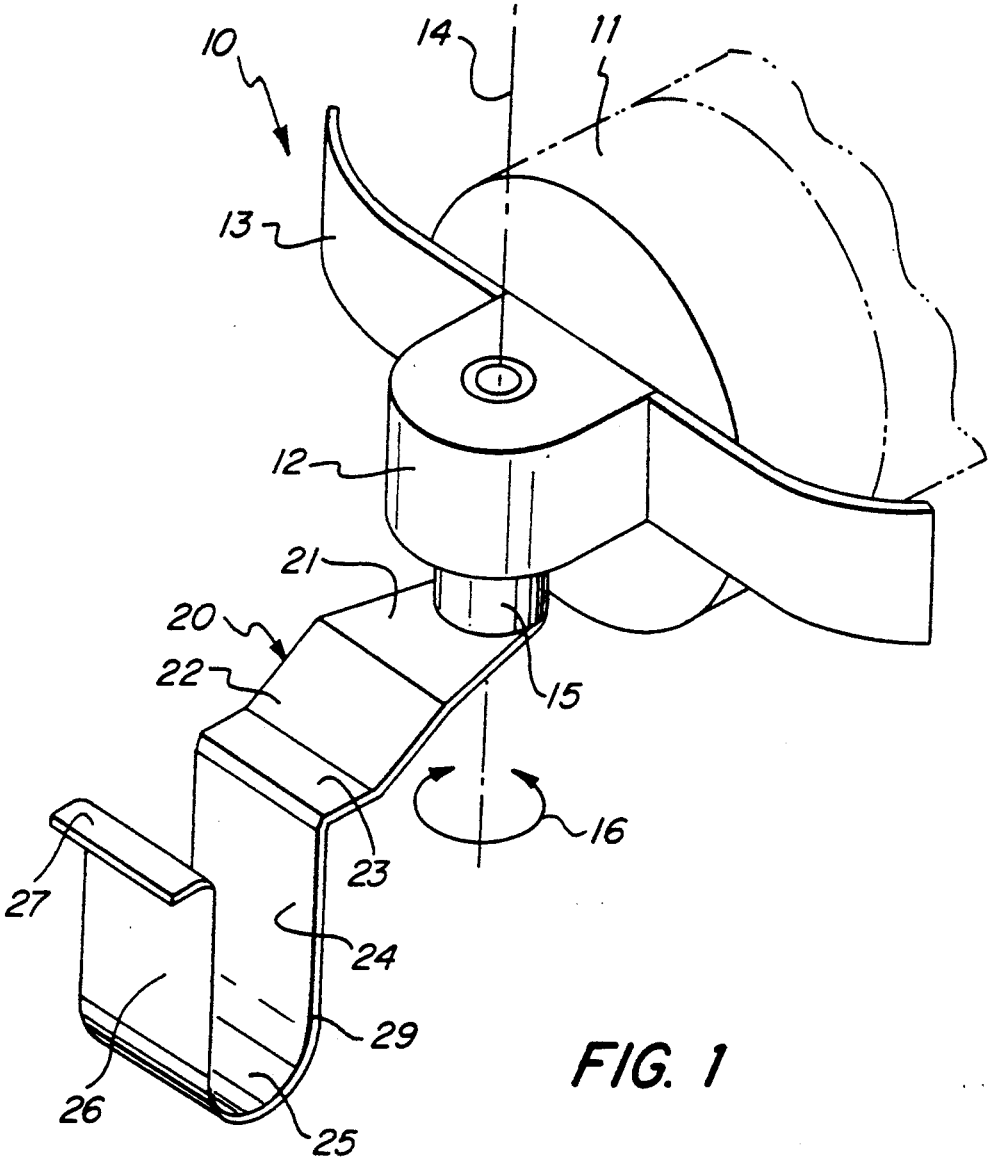
FIG. 1 shows a perspective view of a front portion of one embodiment of the device according to the invention.

In FIG. 1, an electric tool with a housing 11, represented only in part and diagrammatically, is designated by reference numeral 10. Attached to the front of the housing 11, which comprises a drive motor, preferably an electric motor, is a driving flange 12 which may, for example, comprise a miter-wheel gearing. The driving flange 12 is further provided with a hoop guard 13.

An axis 14 extends at a right angle to the longitudinal axis of the housing 11 and is simultaneously the axis of a drive spindle 15 in the driving flange 12. A double arrow 16 indicates that the drive spindle 15 performs an oscillating movement, i.e. rotates forth and back over a small angle. This angle is approximately in the range of between 0.5° and 7°, the oscillation frequency is between 10,000 and 25,000 $min^{-1}$.

Figure 2:
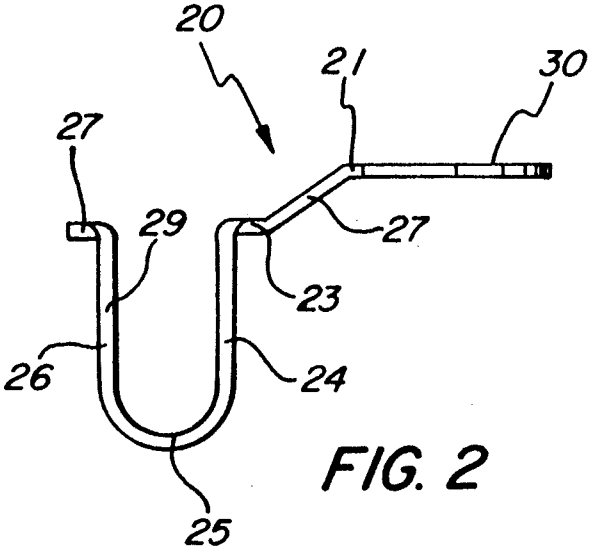
FIGS. 2 and 3 show a side view and a top view of the cutter employed in the embodiment of FIG. 1.
Figure 3:
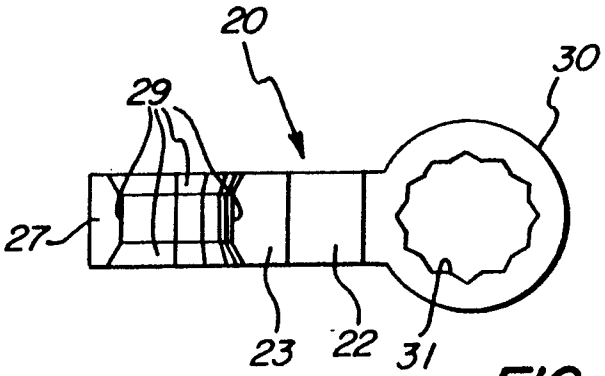

Fitted in the drive spindle 15 is a cutter 20 which is illustrated in more detail in FIGS. 2 and 3. The cutter 20 comprises a first plane section 21, which is followed by a second inclined section 22. The latter is followed by a third plane section 23, followed in its turn by a fourth section 24 projecting in vertical downward direction.

The fourth section 24 is connected, by a fifth section 25, with is curved by 180°, with a sixth section 26, which extends in vertical upward direction. The upper free leg of the sixth section 26 finally terminates by a sevenths plane section extending in opposite direction to the third section 23.

A continuous cutting edge 29 extends over the fourth, fifth and sixth sections 24, 25, 26, which together form a U-shaped structure.

The first plane section 21 terminates, at its right in FIGS. 2 and 3, by a circular extension 30 provided with a central driving profile 31, for example a polygon, forming a driving connection for coupling the tool to the drive spindle 15.

Figure 4:
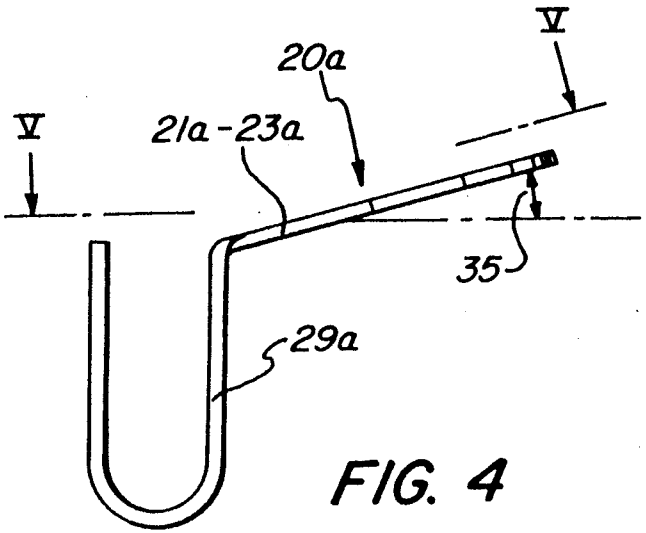
FIGS. 4 and 5 show views, similar to those of FIGS. 2 and 3, but of a somewhat modified embodiment of a cutter.
Figure 5:
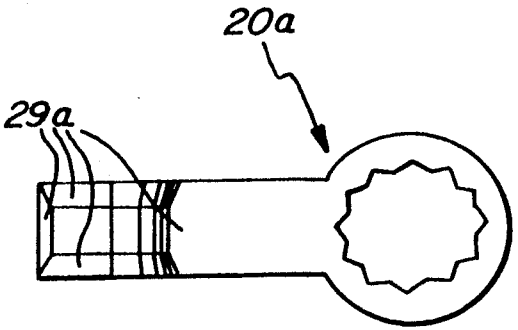

FIGS. 4 and 5 show a slightly modified embodiment of a cutter **20*a* where the first to third sections 21*a* to 23*a* are combined to form a single inclined section extending at an angle 35** of, for example, 15° relative to a horizontal plane.

For the rest, the cutter **29*a* is also designed in the form of a U, although it does not, as illustrated in FIGS. 4 and 5, terminate by a plane section in the form of the section 27 of the embodiment illustrated in FIGS. 2 and 3**.

In the embodiment illustrated in FIGS. 4 and 5, a cutting edge 29 is also provided along the free sections of the U.

Figure 6:
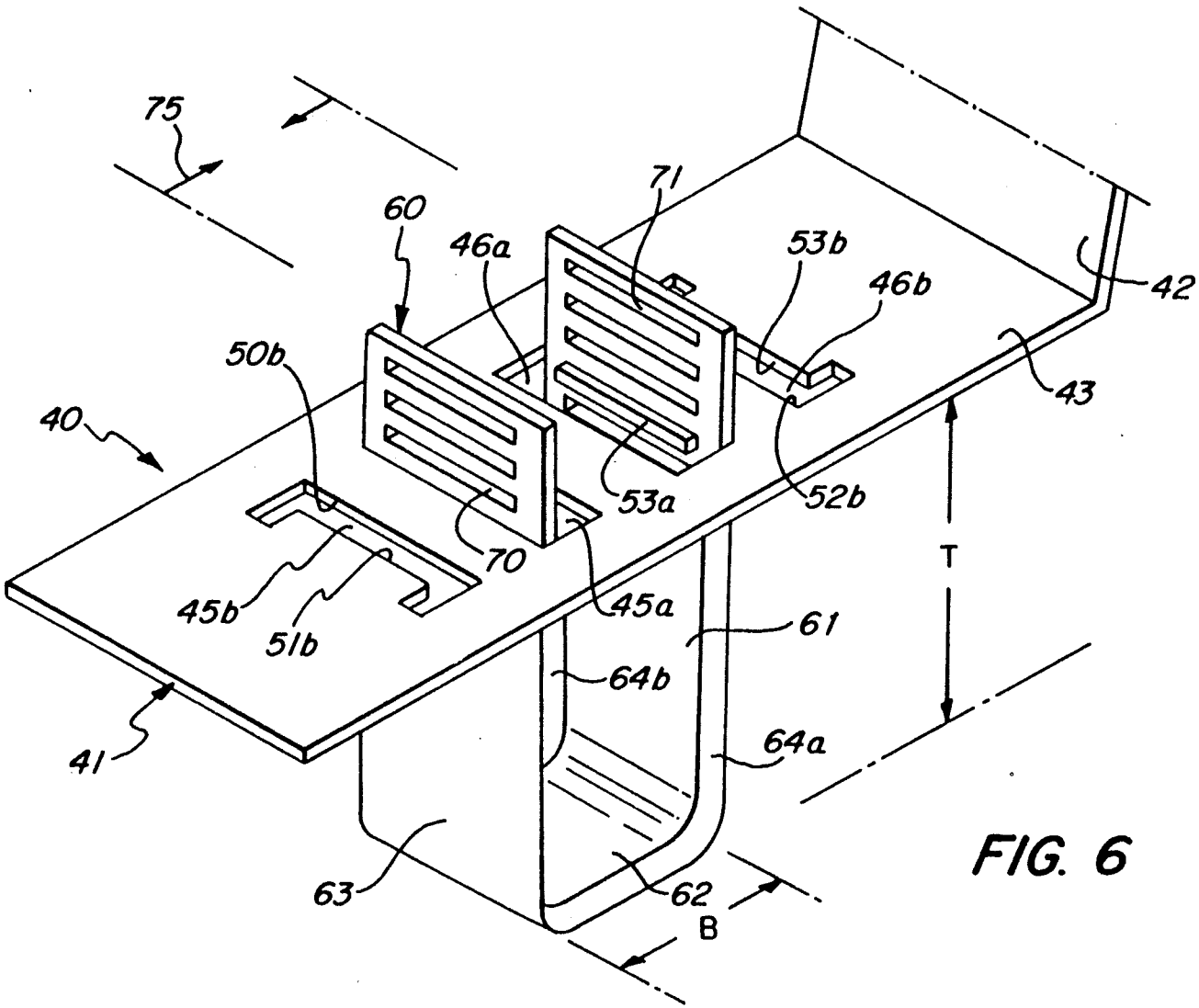
FIG. 6 shows a perspective view, in enlarged scale, of another embodiment of a cutter of the type which can be used for the purposes of the present invention.

FIG. 6 shows still another embodiment of a cutter 40.

The cutter 40 comprises a blade holder 41 which can be connected to the drive spindle 15 in driving relationship, for example by means of a circular section as illustrated at 30, 31 in FIG. 3. For the sake of clarity, this is, however, not shown once more in FIG. 6.

The blade holder 41 comprises a first, inclined section 42 and a second plane section 43. The plane section 43 is provided with slots 45*a*, 45*b*, 46*a*, 46*b*, the total number of which is a multiple of 2. The slots 45*a*, 45*b*, 46*a*, 46*b* are provided in pairs, in mirror-symmetrical arrangement one relative to the other.

Regarding the arrangement from the top, it can be seen that the slots 45*a*, 45*b*, 46*a*, 46*b* form U-shaped openings in the second, plane section 43, the left slots 45*a*, 45*b*—as viewed in FIG. 6—being provided in mirror-symmetrical arrangement relative to the two right slots 46*a*, 46*b*.

Each of the slots 45*a*, 45*b*, 46*a*, 46*b* comprises a full-length longitudinal wall 50, 52, respectively, and on the opposite side a tongue 51, 53, respectively, pointing toward the longitudinal wall 50, 52. The tongues 51*a*, 51*b* of the left slots 45*a*, 45*b*—as viewed in FIG. 6—point toward the right, while the tongues 53*a*, 53*b* of the two right slots 46*a*, 46*b*—as viewed in FIG. 6—are oppositely directed, i.e. to the left.

The cutter 40 further comprises a separate, U-shaped blade 60. The blade 60 comprises a first, vertical section 61, followed at the bottom by a plane section 62, the latter being followed again by a vertical section 63. The three sections 61, 62, 63 are again provided with continuous cutting edges 64*a* and—on the opposite side—64*b*.

The free ends of the vertical sections 61 and 64 are provided with horizontal slots 70, 71, respectively. The width of the slots 70, 71 is equal or a little greater than the width of the tongues 51, 53, while the total width of the vertical sections 61, 63 is equal or a little smaller than the total width of the U-shaped slots 45 and 46.

Due to this arrangement it is possible to introduce the free ends of the vertical sections 61, 63 of the blade 60 from below into a matching pair of U-shaped slots in the second, plane section 43 of the blade holder 41. Preferably, the arrangement is selected in such a way that the user can press the vertical sections 61, 63 of the blade 60 slightly toward each other, by compressing them between his fingers, as indicated by a double arrow 75 in FIG. 6. In this position, the free ends of the vertical sections 61, 63 can be moved past the tongues 51, 53 of the slots 45, 46 until a desired cutting depth T has been adjusted, by pushing the before-mentioned free ends a corresponding length through the slots 45, 46. If in this position the pressure exerted upon the free ends (arrows 75) is released, the elasticity of the blade 60 causes the free ends to spring back away from each other, so that the tongues 51, 53 can engage the respective slots 70, 71, respectively. The free ends of the vertical sections 61, 63 of the blade 60 then come to rest elastically, or possibly at a certain pre-stress, against the recessed portions in the longitudinal walls 50, 52, on either side of the tongues 51, 53, and are locked in this position.

In the case of the embodiment illustrated in FIG. 6, the blade 60 has a width B so that in this case the slots 45*a*, 46*a* have to be used, being spaced by the same distance B.

If blades of a larger width are to be inserted, then the slots 45*b*, 46*b* have to be used which are spaced by a greater amount. Correspondingly, the cutting depth T can be varied by selecting the proper slots 70, 71 to be engaged. While this can be effected with one and the same blade 60, different blades will usually be employed for different widths B.

However, irrespective of which of the described cutters 20, 20*a* or 40 and which of the described blades 60 is employed, the application is always the same.

Figure 7:
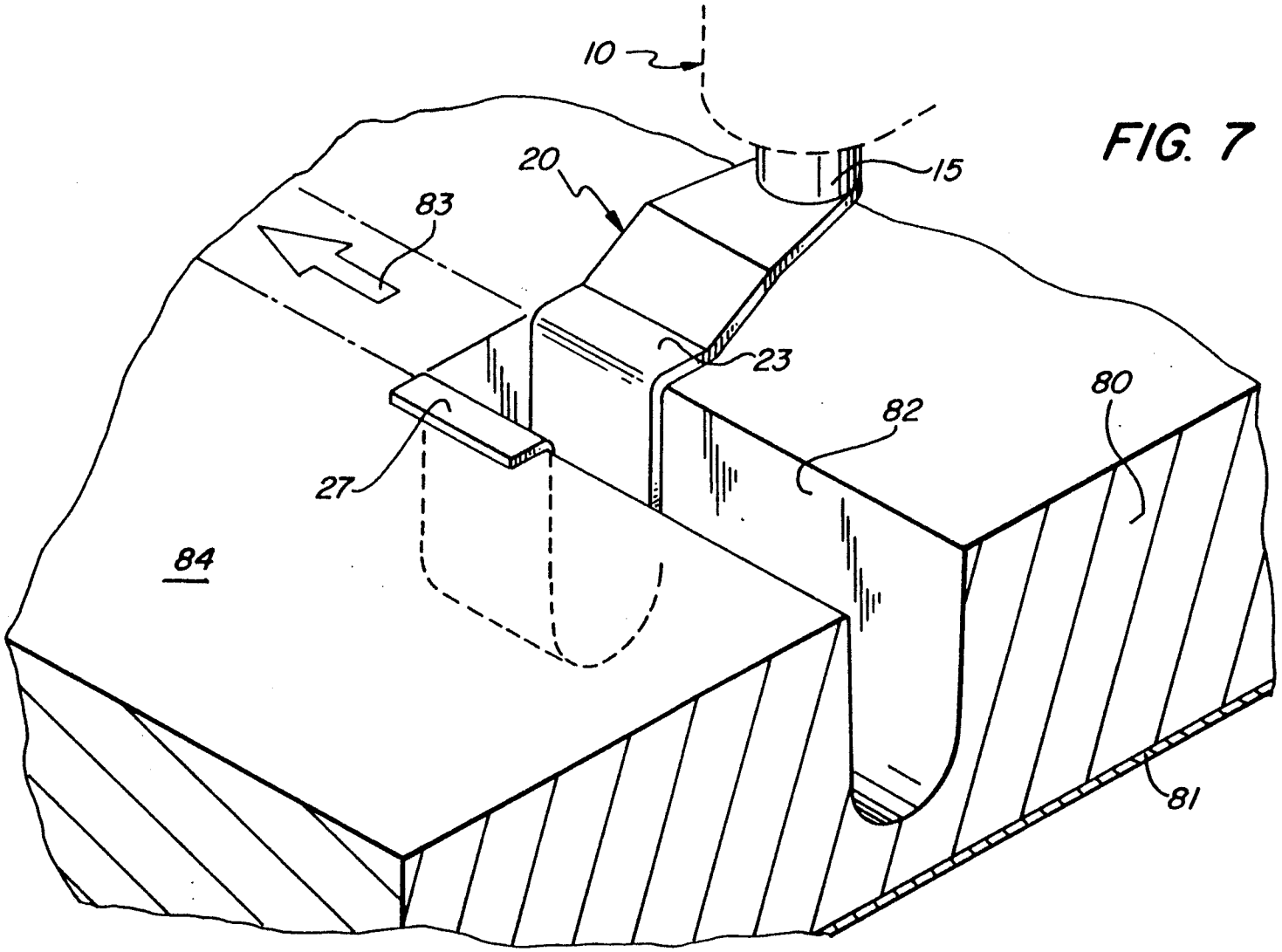
FIG. 7 shows a diagrammatic representation, likewise as a perspective view, illustrating a cutting operation of the kind that may be carried out according to the invention.

FIG. 7 shows in this connection—very diagrammatically—a detail of a sheeting consisting of a soft material, i.e. a glass-fiber or mineral-fiber insulating mat 80. A flat upper surface of the mat 80 is provided with an aluminium lining 81 of the type usually employed as vapor barrier on such insulating mats.

In the case of the example illustrated in FIG. 7, the cutter 20 used is of the kind that has been described and discussed in connection with FIGS. 1 to 3.

The cutter 20 is connected to the drive spindle 15 of the electric tool 10 whereafter the drive is switched on. The cutter 20 then oscillates at the values mentioned at the outset. Now, for cutting a surface channel 82 into the material of the mat 80, the cutter 20 can be introduced into the mat 80 either from one of its sides or by inserting it into the material in oblique direction, at any point of the surface.

In the case of the example illustrated in FIG. 7, the cutter 20 is guided in such a way that the third and the seventh—both plane—sections 23 and 27 of the cutter slide along the surface 84 of the mat 80 so as to serve as vertical stops and to prevent the cutter 20 from sinking into the mat 80 in an uncontrolled way. The cutter 20 is now moved along the surface 84 along a straight line, as indicated by arrow 83 in FIG. 7. By "along a straight line" it is to be understood in this connection that the movement follows the course of the channel to be formed, which may of course also have a curved shape, at least over sections. Consequently, the term "along a straight line" is only meant to say that the channel 82 to be formed has an elongated shape.

Regarding now FIG. 8, another embodiment of a cutter is indicated at 90. This cutter distinguishes itself by the fact that a first straight section 91, which serves for mounting the cutter 90 in the electric tool 10 according to FIG. 1, is followed immediately by a second section 92 of the cutter extending in the same plane, which means that it is neither bent off nor inclined. The second section 92 is followed by a third, bent section 93, which in its turn terminates by a fourth, straight section 94 extending in parallel to the second section 92. The resulting U-shape is illustrated by the side view of FIG. 10, which is turned by 90° relative to the view of FIG. 8.

The second, the third and the fourth sections 92, 93, 94 are provided with a cutting edge extending along all the three sections 92, 93, 94. The cutting edge 95 is toothed.

The toothed design of the cutting edge 95 is particularly advantageous for coarsely structured materials, for example styrene polymers of the kind known under the registered trademark "STYROPOR". These materials consist of material beads having a diameter of 1 or several millimeters. If such materials are cut using plain, or already blunt, cutters, these beads will not be cut through, but will get detached resiliently from the material during the cutting process. This leads to irregular edges and soiling of the working area. Now, it has been found that such materials can be cut advantageously with the aid of toothed or undulated cutting edges, and this in particular when the spacing of the teeth or undulations is at least equal to the diameter of the beads.

Further, it can be readily seen in FIG. 8 that the cutting edge 95 is curved in longitudinal direction. Although the configuration drawn in full lines shows a convex shape, it goes without saying that a concave shape may be employed for certain applications,. as indicated for example by the dash-dotted line 45*a* in FIG. 8.

Finally, another variant of a cutter 90' is provided with a plain cutting edge 95*b*, as illustrated in FIG. 9. For the rest, the cutter 90' of FIG. 9 is absolutely identical to the cutter 90 of FIG. 8. Consequently, the side view of FIG. 10, which is turned by 90°, is also identical in all cases.

Reference numeral 95*b'* in FIG. 9 further indicates that the cutter 90' may be provided with different cutting edges on the right and the left sides, as viewed in FIG. 9. While the right side—as viewed in FIG. 9—is provided with a straight, but toothed cutting edge 95*b*, the left side—as viewed in FIG. 9—is provided with a likewise straight, but plain cutting edge 95*b'*. This illustration is intended to indicate that quite apart from their general shape, the cutters may be provided with different cutting edges 95*b* and 95*b'* in the two cutting directions right/left so that one and the same cutter 90' can be used for cutting two different materials, simply by changing the cutting direction, i.e. the direction in which the tool has to be moved.

In FIG. 9, reference numeral 96 designates an axis about which the cutters 90, 90' perform the oscillating movement.

If one regards in this connection the illustration of FIG. 1, it will be readily appreciated that in the case of the preferred electric drive of the cutter 10, the oscillating drive shaft 14 extends at an angle of 90° relative to the longitudinal axis of the housing 11. If, therefore, one of the cutters 90, 90' illustrated in FIGS. 8 to 10 is employed with this cutting tool 10, then the cutting edges 95, 95*b* provided on the longitudinal sections 92 and 94 extend along an imaginary extension of the longitudinal axis of the cutting tool 10, whereas in the case of the embodiments described before, they extend at an angle of 90° relative to the longitudinal axis of the cutting tool 10.

It is understood, however, that this differentiation is meant as an example only and that the cutters 90, 90' of FIGS. 8 to 10, just as the cutters that will be described further below, may as well be bent off or arranged at an angle similar to those which are illustrated in FIGS. 1 to 7. The same applies conversely to the previously described embodiments illustrated in FIGS. 1 to 7, which may also be given a straight design, instead of being bent off or arranged at an angle.

For the rest, the application of the cutters 90, 90' illustrated in FIGS. 8 to 10 is identical to what has been described above with respect to the cutters of FIGS. 1 to 7.

In contrast, FIGS. 11 to 14 show other embodiments of cutters which, regarded from the side, do not present the shape of a U, but only that of an L or only a straight shape.

FIG. 11, for example, shows a cutter 100 comprising a first, straight mounting section 101, followed by a second, likewise straight section 102. The arrangement conforms insofar with the sections 91, 92 of the cutter 90 illustrated in FIG. 8.

The second, straight section 102 of the cutter 100 is provided with a cutting edge 103 which is undulated in the illustrated embodiment. As regards the design of the cutting edges in undulated or toothed shape, the same considerations apply as have been discussed above in connection with FIGS. 8 to 10, and it is again understood that the described design of the cutting edges is meant as an example only and that all cutters described in connection with the present invention may be provided with plain, toothed or undulated cutting edges, in straight or bent form.

A first variant of the cutter 100 according to FIG. 11, which is illustrated in FIG. 12, consists of a cutter 100' equipped merely with the second straight section 102. In the case of another variant, which is illustrated in FIG. 13, a cutter 100'' has its lower free end of the second straight section 102 followed by a third, likewise straight section 104, which is bent off by 90°. According to a third variant, a cutter 100''', illustrated in FIG. 14, has the lower end of the second straight section 102 followed by a likewise bent-off third section 104*a*, but in this case this third section extends at an obtuse angle relative to the straight section 102.

Reference numeral 105 in FIG. 12 indicates again that the cutters 100 of FIGS. 11 to 14 oscillate about an axis which extends at an angle of 90° relative to the cutting edge 103 of the second straight section 102, similarly to what has been described for the axis 96, in connection with FIG. 10.

The application of the cutters 100 of FIGS. 11 to 14 is somewhat different from what has been described above with reference to FIGS. 1 to 10.

In order to cut a surface channel into a sheeting using the cutters illustrated in FIGS. 11 to 14, two operations are necessary.

Initially, a first longitudinal cut is made in the sheeting using a bent-off cutter 100'' or 100'''. As a result of this first operation, the surface channel is already cut out on two of three sides. The third side of the surface channel is then cut out by a further operation. This may be effected either by passing a bent-off cutter 100'' or 100''' through the sheeting in opposite direction, so that the third side of the surface channel is cut out substantially by the cutting edge 103 provided on the second straight section 102. Alternatively, however, a straight cutter 100', as illustrated in FIG. 12, may be employed for the second operation in order to cut out the third side of the surface channel.

If in this case surface channels of a width greater than the width of the third bent-off surface channel 104 are desired, the two operations may be repeated thereafter once more or several times. The bent-off cutter 100'' is then passed through the existing surface channel in such a way that the second, straight section 102 slides along one of the side walls of the surface channel and the third bent-off section 104 produces another lateral horizontal cut. The material strip, having been cut out in this way on one side, is then again cut off by a second cut using the cutter 100'' or 100'.

FIGS. 15 to 22 show further embodiments of the invention, where an additional support is provided for the free leg of the U-shaped cutting edge.

Figures 15, 16, 17, 18, 19, 20, 21, 22:
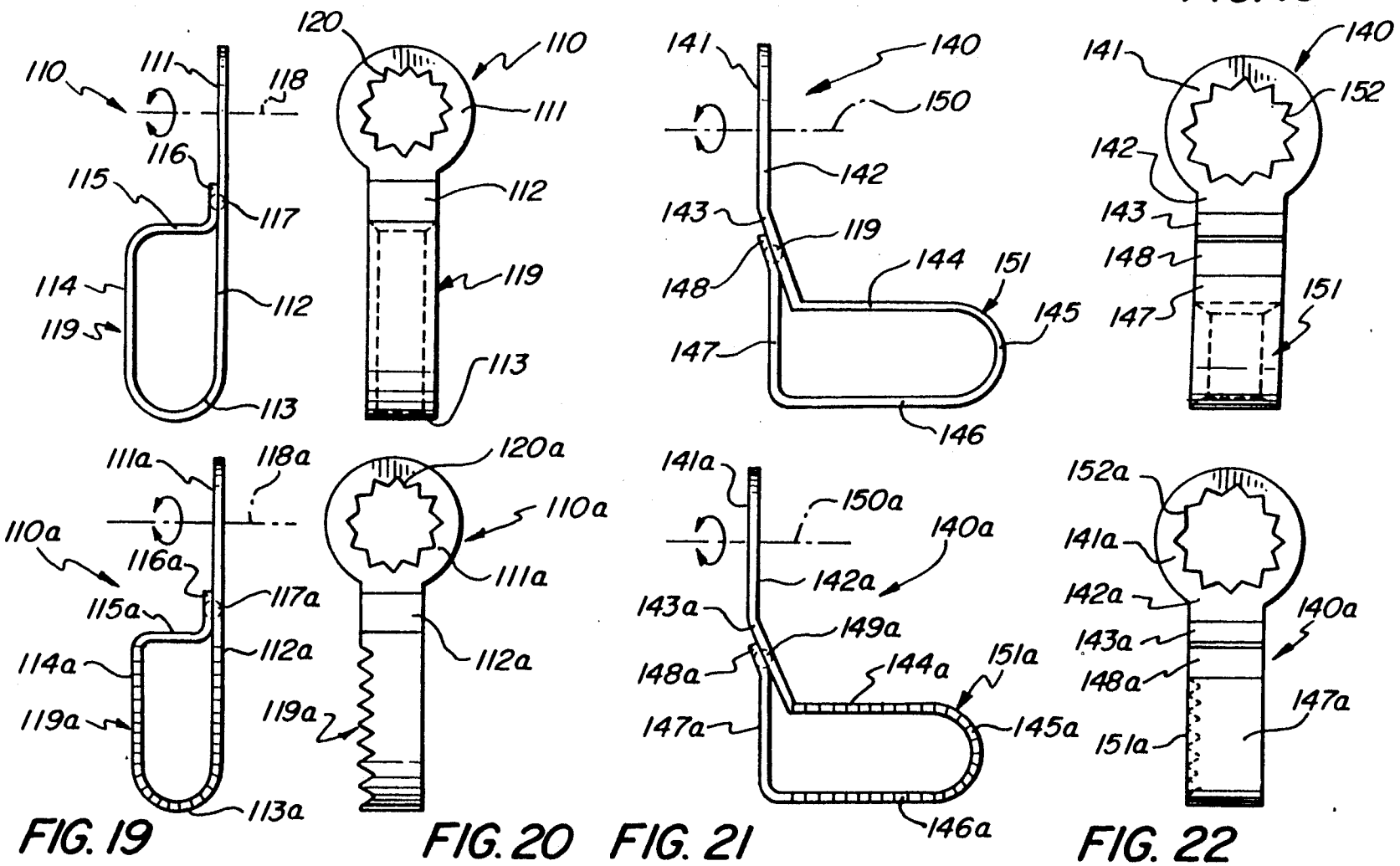
FIG. 15 shows a side view of a variant of the embodiment illustrated in FIG. 9.
FIG. 16 shows a side view of the embodiment according to FIG. 15, but turned by 90°.
FIG. 17 shows a side view of another variant of the embodiment according to FIG. 2.
FIG. 18 shows a side view of the embodiment according to FIG. 17, but turned by 90°.
FIG. 19 shows a side view of another variant of the embodiment according to FIG. 15.
FIG. 20 shows a side view of the embodiment according to FIG. 19, but turned by 90°.
FIG. 21 shows a side view of another variant of the embodiment according to FIG. 17.
FIG. 22 shows a side view of the embodiment according to FIG. 21, but turned by 90°.

The cutter illustrated in FIGS. 19 and 20, and designated generally be reference numeral 110*a*, is substantially identical to the cutter illustrated in FIGS. 9 and 10, except that an additional support for the outer free leg of the section forming the U is provided on the mounting end. The cutter 110*a* comprises a first plane section 112*a* equipped with a circular extension provided with a driving profile 120*a* in the form of a polygon. The driving profile 120*a* serves to couple the cutter with the drive spindle 15 of the electric tool 10, by which the cutter 110*a* can be set into oscillating movement about the axis 118*a*. The first plane section 112*a* is followed by the U-shaped cutting edge 119*a*, comprising part of the first section 112*a*, a bent section 113*a* and a third plane section 114*a* which latter extends in parallel to the first section 112*a*. The third plane section 114*a* is followed by a section 115*a* which is bent off by an angle of about 90° and which points toward the first plane section 112*a*. The fourth bent-off section 115*a* is followed by another, fifth section 116*a*, which is bent off at an angle of about 90° and which extends in parallel to the first plane section 112*a*. The fifth section 116*a* rests on the first plane section 112*a* and is fixed thereto by spot welding, as indicated at 117*a*. As a result of this arrangement, the U-shaped cutting edge 119*a* is closed at its upper end by the fourth and fifth sections 115*a*, 116*a*, and is supported on the first section 112*a*.

This achieves considerably improved stability for the cutter 119*a* and a much lower risk of breakage.

As in the case of the embodiment mentioned before in connection with FIGS. 9 and 10, the cutter 119*a* is toothed.

The embodiment designated generally by reference numeral 110 in FIGS. 15 and 16 differs from the embodiment described above with reference to FIGS. 19 and 20 only insofar as the cutter 119 has a straight shape and is not toothed. The cutting edge 119 tapers toward both ends of the cutter 100 so that it is suited to cut in both directions.

FIGS. 17 and 18 show a modification of the embodiment discussed with reference to FIGS. 2 and 3.

The cutter 140 comprises a first, plane section 142, followed by a second, inclined section 143. The latter in turn is followed by a third, vertical section 144 terminating by a fourth section 145 which is bent by 180°. The end of the bent section 145 is then followed by another section 146, extending perpendicularly to the first section 142 and in parallel to the third section 144.

The U-shaped cutter 151 is formed by the two legs of the third section 144 and the fifth section 146, and the bent section 145 enclosed between them. The end of the fifth section 146, opposite the bent section 145, is followed by a sixth section 147, which is bent off at a right angle, and the latter in its turn is followed by another inclined section 148. This latter inclined section 148 rests against the second inclined section 143 and is fixed to the latter by spot welding, as indicated at 119. Consequently, the U-shaped cutter 115 is supported again on its mounting end via the bent-off section 147 and the inclined section 148, whereby greater stability is achieved and the risk of breakage is reduced. The cutting edge 151 is formed on both sides of the sections 144, 145, 146 so that the cutter 140 can be used for cutting in both directions.

The embodiment indicated generally by reference numeral 140*a* in FIGS. 21 and 22 differs from the embodiment described above with reference to FIGS. 17 and 18 only by the toothed cutting edge 151*a*. While in the illustrated embodiment the cutting edge 151*a* is formed only on one side of the cutter 140*a*, it might of course also be provided on both sides in order to permit cutting in both directions.

The above description of numerous possible embodiments of the invention shows that there exists a wide range of variation which can be utilized to translate the invention into practice. In particular, other shapes of the cutters or the cutting edges can be imagined in order to adapt the invention to special applications, materials, channel shapes, or the like. Further, it is understood that special applications with selected materials may be envisaged with advantage for certain embodiments of the cutters, in particular for the toothed or undulated straight cutters, even if such applications do not in each case relate to cutting out surface channels.

We claim:

1. A cutter for producing U-shaped surface channels in a relatively soft sheet of material, using a motor operated cutting tool having a drive spindle operating said cutter by moving same oscillatingly about an axis at a small angular amplitude and high frequency along the course of a channel to be formed, said cutter comprising:

a U-shaped member having first and second upright portions joined by a curved bottom portion forming said U, said U-shaped member providing a continuous U-shaped cutting edge;

a first shoulder having an inner end and an outer end, said first shoulder extending from its inner end transversely from a top end of said first upright portion towards its outer end in a first direction away from said second upright portion;

a second shoulder having an inner end and an outer end, said second shoulder extending from its inner end transversely from a top end of said second upright portion towards its outer end in a second direction opposite to said first direction and away from said first upright portion, and mounting means extending from said second shoulder outer end generally along said second direction and terminating at a coupling for mounting said cutter to said drive spindle.

2. A cutter in accordance with claim 1 wherein said first and second shoulders limit the penetration of said cutter into said sheet of material.

3. A cutter in accordance with claim 1 wherein said cutter is formed from a continuous strip of material that is bent to provide said first shoulder followed by said U-shaped member, said second shoulder and said mounting means.

4. A cutter in accordance with claim 1 wherein said U-shaped member is open at a top portion thereof opposite said curved bottom portion.

5. A cutter in accordance with claim 4 wherein said cutter is formed from a continuous strip of material that is bent to provide said first shoulder followed by said U-shaped member, said second shoulder and said mounting means.

* * * * *